US009562527B2

(12) United States Patent
Spiegl et al.

(10) Patent No.: US 9,562,527 B2
(45) Date of Patent: Feb. 7, 2017

(54) UNLOADER FOR A VALVE ELEMENT OF A COMPRESSOR VALVE

(71) Applicant: HOERBIGER KOMPRESSORTECHNIK HOLDING GMBH, Vienna (AT)

(72) Inventors: Bernhard Spiegl, Vienna (AT); Markus Testori, Hollabrunn (AT); Andreas Schloffer, Vienna (AT)

(73) Assignee: Hoerbiger Kompressortechnik Holding GmbH, Vienna (AT)

( * ) Notice: Subject to any disclaimer, the term of this patent is extended or adjusted under 35 U.S.C. 154(b) by 68 days.

(21) Appl. No.: 14/516,840

(22) Filed: Oct. 17, 2014

(65) Prior Publication Data

US 2015/0139835 A1 May 21, 2015

(30) Foreign Application Priority Data

Nov. 21, 2013 (AT) ..... A 50773/2013

(51) Int. Cl.

| | |
|---|---|
| ***F04B 39/08*** | (2006.01) |
| ***F04B 49/24*** | (2006.01) |
| ***F04B 49/03*** | (2006.01) |
| ***F04B 39/10*** | (2006.01) |

(52) U.S. Cl.

CPC ..... *F04B 39/08* (2013.01); *F04B 39/1053* (2013.01); *F04B 49/03* (2013.01); *F04B 49/243* (2013.01)

(58) Field of Classification Search

CPC ..... F04B 39/08; F04B 49/243; F04B 49/03; F04B 39/1053

USPC ..... 137/522

See application file for complete search history.

(56) References Cited

U.S. PATENT DOCUMENTS

| | | | | |
|---|---|---|---|---|
| 1,769,899 | A * | 7/1930 | Mathews | F16K 15/12 137/512.1 |
| 4,869,291 | A | 9/1989 | Hrabal | |
| 5,025,830 | A * | 6/1991 | Kursar | F04B 49/243 137/522 |
| 5,249,595 | A | 10/1993 | Fink | |
| 5,634,492 | A | 6/1997 | Steinrück et al. | |
| 8,500,420 | B2 | 8/2013 | Spiegl et al. | |
| 2008/0149195 | A1* | 6/2008 | Spiegl | F04B 39/08 137/528 |
| 2012/0152379 | A1* | 6/2012 | Lagler | F04B 39/08 137/511 |
| 2014/0294619 | A1 | 10/2014 | Mangiagli | |

FOREIGN PATENT DOCUMENTS

| | | |
|---|---|---|
| DE | 19723152 | 1/1999 |
| GB | 1092647 | 11/1967 |

OTHER PUBLICATIONS

English Abstract of DE19723152.

* cited by examiner

*Primary Examiner* — Mary McManmon
*Assistant Examiner* — Patrick Williams
(74) *Attorney, Agent, or Firm* — Dykema Gossett PLLC

(57) ABSTRACT

An unloader for a valve element (30) of a compressor valve (40) includes an unloader finger (2) and one carrier bushing (14), wherein the unloader finger (2) is fabricated from a first material, the carrier bushing (14) is fabricated from a second material using a casting method, and at least part of the unloader finger (2) is mold in with the material of the carrier bushing (14).

16 Claims, 5 Drawing Sheets

UNLOADER FOR A VALVE ELEMENT OF A COMPRESSOR VALVE

BACKGROUND OF THE INVENTION

Field of the Invention

The invention relates to an unloader for a valve element of a compressor valve, the unloader including a number of unloader fingers and a guide bushing. The invention also relates to a method for producing such a unloader.

The Prior Art

Unloaders are known in a variety of embodiments and are used for regulating plate and ring valves for compressors and the like. In principal unloaders are used for preventing the valve from closing and thus enables backflow of the medium to be compressed out of the compression space, generally the suction chamber. Continuously holding it open can stop the output of the compressor or cause the compressor to idle. Furthermore, lifting valve elements is frequently used for starting up the compressor with a minimal load or even to attain stepless control of the compressor.

Due to the high stress and the high dynamics, most unloaders are made from a solid piece. The turning, milling, and cutting operations cut away more than 80% of the starting material. The unloaders produced from a solid piece are stable and extremely vibration resistant; however, they are very expensive due to the high material and production costs.

DE15 03 426 A1, for instance, provides as a more cost-effective variant a unloader that comprises a metal bushing, concentric gripper rings, ribs arranged in a star shape, and unloader fingers that cooperate with a valve plate. The bushing is fabricated in the normal manner by turning or casting. The concentric gripper rings carry the metal unloader fingers, which cooperate with the valve plate, and are connected to one another by the ribs arranged in a star shape and to the bushing. The individual components are held together using weld joints. To provide accessibility during the joining process, only a small number of the ribs arranged in a star shape are embodied continuous from the outermost gripper rings to the bushing, in order to still provide adequate stiffness, the outer gripper rings are joined to one another by additional short ribs.

It is to be considered a drawback that a great number of welding processes, and significant time, are required for production. It should also be noted that the bushing must comprise a metal material that permits joining by welding. Based on this, with respect to slide properties, it must be assumed that the material pairing between bushing and the associated guide pins on the valve are not optimum. This drawback is particularly significant in dry running applications in which lubrication is not possible for various reasons. In addition, thermal deformation during the joining process can make it necessary to re-machine the bushing, especially the guide surfaces. Since all of the components in the unloader are made of metal, its weight is also therefore correspondingly heavy, which then limits the possible dynamics.

EP 0 888 770 B1 provides an unloader for compressor valves having a carrier and a number of unloader fingers secured thereto. At their end facing the carrier, the unloader fingers are provided with a retaining element that makes a positive fit with the carrier. This retaining element has a positioning element and a fixing element that snaps to the carrier in the assembly position. The center of the carrier is embodied as a bushing through which the carrier is guided on a guide sleeve. To improve the guidance and to reduce friction losses, slide rings are provided inside the guide sleeve.

The complex configuration of the guide region is a drawback with respect to ensuring appropriate positive slide conditions, even for dry running applications. The limited selection of materials for the unloader fingers, which materials must have both adequate strength for operation and appropriate elasticity for the snap-in connection, must be considered a drawback. Although compared to the variant described in the foregoing in which the unloader is fabricated from a solid piece, the materials expense is significantly reduced, due to the multi-part construction the loading of the unloader fingers can result in clearance, especially on the contact surfaces between the unloader fingers and the carrier. The weight is slightly reduced compared to the aforesaid DE15 03 426 A1; nevertheless, due to its weight the heavy metal carrier and the bushing formed thereon permit only limited dynamics.

One object of the present invention is to be able to manufacture, while reducing the weight and as cost-effectively as possible, an unloader of the aforesaid type for a valve element of a compressor valve, and to prevent signs of wear, such as for instance the occurrence of clearance between unloader fingers and their carrier structure.

SUMMARY OF THE INVENTION

This object is inventively attained an unloader with an unloader finger and which is fabricated from a first material, a carrier bushing fabricated from a second material using a casting method, and at least part of the unloader finger is mould in with the material of the carrier bushing. Due to the mufti-part construction and the casting in of at least part of the unloader finger, the unloader may be fabricated with minimum material consumption. Since at least part of the unloader finger is cast into the carrier bushing, it is almost impossible for a clearance to develop between unloader finger and carrier structure in the form of carrier bushing. Moreover, the casting method permits a design with less material so that weight is effectively saved. This effect may be even more pronounced depending on the material selected.

One advantageous embodiment provides that the carrier bushing has a guide area for guiding the unloader. The guide area is therefore already fabricated when the carrier bushing is being cast and subsequent addition of any bushings or slide rings is not necessary. This reduces the number of components and complexity of assembly, which also saves costs.

It is advantageously provided that the guide area is arranged on the radially interior circumferential surface of the carrier bushing. This permits a simple and space-saving construction in which the unloader is guided on a central guide pin, for instance.

One advantageous embodiment provides that the carrier bushing is fabricated from plastic or fiber-reinforced plastic. This permits a design that has the lightest weight while still having high strength. The low weight compared to metal materials permits high actuation dynamics. If, as stated in the foregoing, the guide area is also embodied by the carrier bushing, there are excellent sliding conditions, especially for dry running applications. It is therefore possible to do without the use of slide elements on a guide pin of the unloader, so that the design is correspondingly simplified.

In a further advantageous manner it is provided that the unloader finger is joined to a force transmitting ring at a central area that faces the valve element. Because of this, the forces that act on the unloader fingers are not carried directly into the carrier bushing. The force transmitting ring thus imparts additional stability and rigidity to the unloader.

One advantageous embodiment provides that the unloader finger has a groove on its central area that faces the valve element and that the unloader finger is hooked by means of the groove to a first contact point between force transmitting ring and unloader finger in the force transmitting ring. Because it is hooked to the first contact point between force transmitting ring and unloader finger on the force transmitting ring, the unloader finger is correspondingly positioned without fixing elements or connecting elements, such as for instance screws or the like, being necessary. If the casting method for producing the carrier bushing is performed following this hooking on, it is possible to also mould in at least part of the already positioned force transmitting ring.

One advantageous embodiment provides that at one axial end that faces away from the valve element the unloader finger is joined to a connection ring. The forces that occur on the unloader fingers are conducted into the connection ring via the axial end that faces away from the valve element. This unloads the bushing and imparts more additional stability to the unloader.

If is advantageously provided that at its axial end that faces away from the valve element the unloader finger has a recess and that the connection ring has as a second contact point between connection ring and unloader finger on its exterior or interior radial circumferential surface a circumferential projection that cooperates with the recess of the unloader finger such that the recess of the unloader finger engages in the circumferential projection and thus in the connection ring. The hooking in is a simple opportunity to position and fix the connection ring without having to provide corresponding fixing elements, such as screws or the like. Additional components are therefore not needed so that costs are reduced. There is no need to align any through-bores or threaded bores, as would be necessary if screws were used for fixation.

One advantageous embodiment provides that the unloader finger and the force transmitting ring are mould in at least at the first contact point between force transmitting ring and unloader finger and/or the unloader finger and the connection ring are mould in at least at the second contact point between connection ring and unloader finger, at least in part, with the material of the carrier bushing. This ensures secure retention of all components in a simple manner.

Another advantageous embodiment provides that the carrier bushing has a segment with a non-circular cross-section. Since the unloader fingers are guided through corresponding slits in the valve seat, which slits are interrupted by radial bars, in principle it is necessary to prevent the unloader fingers from coming into contact with the radial bars due to twisting. This would lead to undesired wear on the valve seat and on the unloader fingers, possibly damaging the valve seat and the unloader fingers or resulting in a malfunction due to increased friction. When using an appropriately shaped, relative to the valve seat, rotation-fast counter-part, twisting may be effectively prevented by a non-circular cross-section. In contrast, a conventional, multi-part embodiment, for instance with plastic blocks screwed onto the valve seat, adds significant additional costs and increased complexity in terms of assembly.

One advantageous embodiment provides that the guide area of the carrier bushing is embodied as a non-circular segment. In combination with a corresponding guide pin that is provided for guiding the unloader, with a corresponding cross-section, this provides anti-twist protection as well as guidance.

BRIEF DESCRIPTION OF THE DRAWINGS

The subject invention shall be explained in greater detail in the following drawings, which depict exemplary, schematic, and non-limiting advantageous embodiments of the invention.

DETAILED DESCRIPTION OF THE PREFERRED EMBODIMENTS

Figure 1:
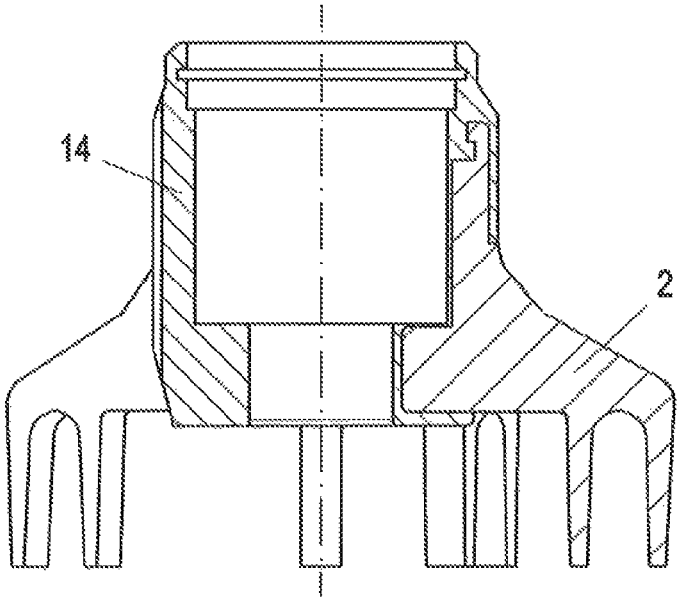
FIG. 1 is a sectional view of the inventive unloader.

FIG. 1 depicts an inventive unloader 1. In the depicted embodiment, a plurality of unloader fingers 2, for instance 6 unloader fingers, are used. A carrier bushing 14 is molded using a casting method, for instance die-casting or injection molding, wherein at least part of the unloader fingers 2 are mould in with the material of the carrier bushing. The material that the carrier bushing 14 is cast from does not necessarily have to be the same material that the unloader fingers 2 are fabricated from, but naturally this option is possible.

A metal material, for instance a steel alloy that has the appropriate fatigue strength and wear resistance, may be provided for the unloader fingers 2, but other materials may also be used. Metal materials, preferably with good slide properties, such as for instance bronze alloys, that is alloys having a high copper and tin content, may likewise be provided for the carrier bushing 14, since these alloys have good slide properties and high resistance to material fatigue. To attain the lowest possible total weight, in particular for the carrier bushing 14, it is also possible to use plastics, such as for instance polyamides, that may additionally be embodied with fiber reinforcement. They are have high strength, rigidity, and toughness and also have good slide properties. Naturally other materials or combinations of materials may also be used.

Figure 2:
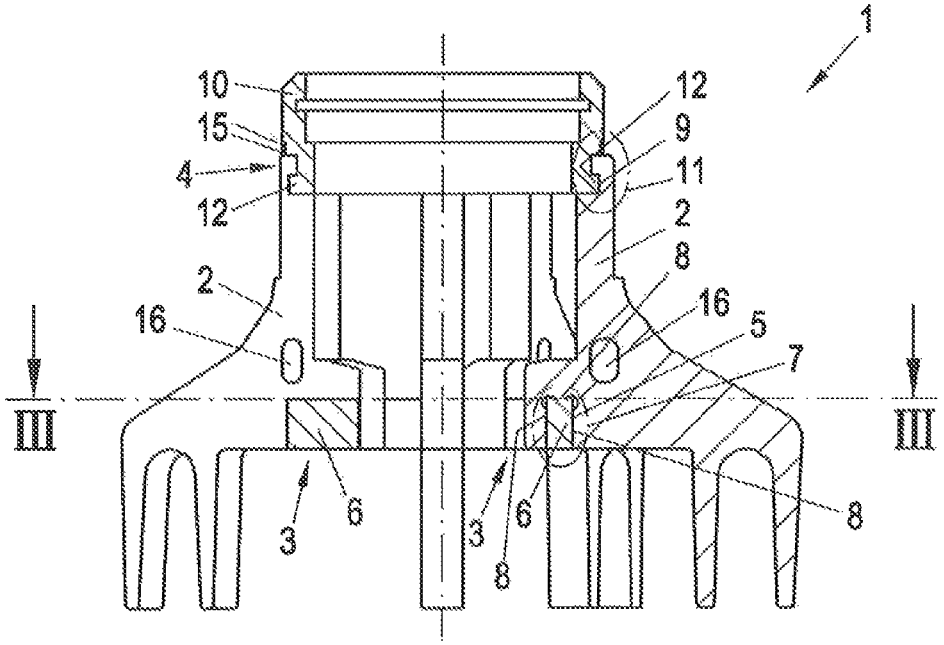
FIG. 2 is a sectional view of the advantageously embodied, pre-assembled unloader.

FIG. 2 depicts one advantageous embodiment of the inventive unloader 1 in a pre-assembled stage. In the depicted embodiment, the unloader fingers 2 are joined to a central area 3 that faces a valve element 30, depicted in FIG. 6, with a first force transmitting ring 8 at the first contact points 7 between force transmitting ring 6 and unloader finger 2 (see also FIG. 3). The force transmitting ring is preferably fabricated from metal. The first contact points 7 between force transmitting ring 6 and unloader finger 2 are embodied in the form of contact surfaces 8 on the force transmitting ring 6. In addition, at its central area 3 each unloader finger 2 has a groove 5, the depth and width of which is embodied to fit the contact surfaces 8 of the force transmitting ring 6.

Each of the unloader fingers 2 is hooked in by means of its grooves 5 at one of the first contact points 7 between force transmitting ring 6 and unloader finger 2 and is positioned via the contact surfaces 8. The axial position of the unloader fingers 2 is fixed in that the base of the grooves 5 comes to rest on the top side of the force transmitting ring 6, which top side faces away from the valve element 30, and which also represents a contact surface 8. The unloader fingers 2 are positioned in their orientation by this hooking into the force transmitting ring 6.

Each unloader finger 2 is furthermore joined, at its axial end 4 that faces away from the valve element 30, to a connection ring 10. To this end, the unloader fingers 2 each have at their axial end 4 at a second contact point 11 between connection ring 10 and unloader finger 2 a recess 9, for instance a groove oriented inward or outward. The connection ring 10 has, on its interior or exterior radial circumferential surface, at the second contact points 11 between connection ring 10 and unloader finger 2, a circumferential projection 12 that cooperates with the recess 9 of each unloader finger 2 such that the recesses 9 of the unloader fingers 2 engage in the circumferential projection 12 and thus in the connection ring 10.

Naturally an embodiment in which the force transmitting ring 6 and/or the connection ring 10 are not used is also possible. If the force transmitting ring 6 is not used, the central area 3 of the unloader finger 2 does not have to have a groove 5, as is also depicted in FIG. 1. If the connection ring 10 is not used, the unloader finger 2 does not have to have a recess 9 at its axial end 4, facing the valve element 30, on its interior or exterior radial circumferential surface, as is also already depicted in FIG. 1.

As mentioned in the foregoing, the unloader fingers 2 are already held in a certain position by being hooked in at the force transmitting ring 6. Due to the recess 9, the wall thickness of the unloader fingers 2 is reduced at the second contact point 11 between connection ring 10 and unloader finger 2, which permits some elastic deformation. This permits the connection ring 10 to snap in at the second contact point 11 between connection ring 10 and unloader finger 2.

In the unloader 1 pre-assembled in this manner and depicted in FIG. 2, therefore, the individual components already hold together somewhat, which facilitates handling of the unloader 1, which is not yet completely assembled, in the following step.

The depicted embodiment of the first contact point 7 between force transmitting ring 6 and unloader finger 2 and of the second contact point 11 between connection ring 10 and unloader finger 2 represents a simple variant that is not complicated to produce and that may be assembled rapidly and simply. Naturally other positive and/or non-positive fit embodiments are possible in the design of the first contact point 7 between force transmitting ring 6 and unloader finger 2 and of the second contact point 11 between connection ring 10 and unloader finger 2, for instance using appropriate threads, other types of plug-in connections, or the like.

Figure 3:
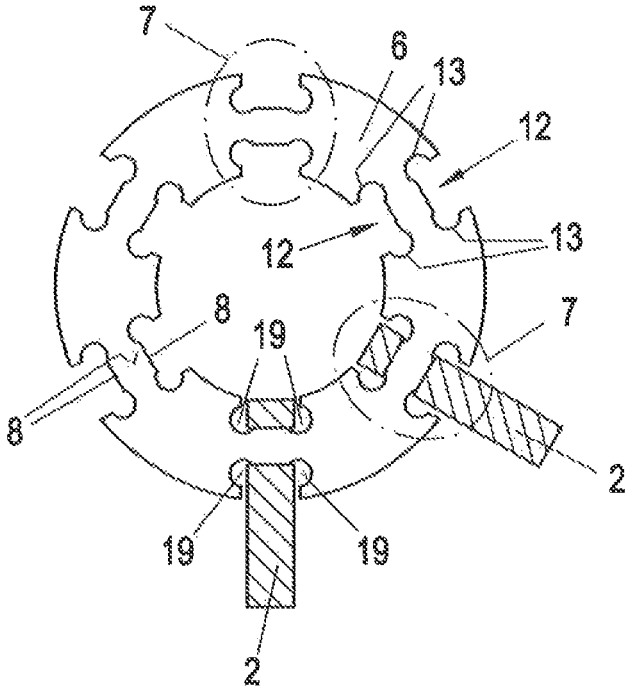
FIG. 3 is a section along the line III-III in FIG. 2.

FIG. 3 is a section along the line III-III in FIG. 2. As an example, the force transmitting ring 6 for six unloader fingers 2 is embodied having corresponding contact surfaces 8 in a regular arrangement.

The force transmitting ring 6 is for instance embodied at the first contact point 7 between force transmitting ring 6 and unloader finger 2 by groove-like recesses 12 on the exterior and/or interior surface of the force transmitting ring 6. The resultant contact surfaces 8 are embodied in the base of the groove-like recesses 12 and on the top side of the force transmitting ring 6. Curved recesses 13 that form free spaces 19 between the force transmitting ring 6 and the central area 3 of the unloader fingers 2 at the first contact point 7 between force transmitting ring 6 and unloader finger 2 are provided on the edges of the groove-like recesses 12 formed on the base of the groove, which recesses 12 are adjacent to the contact surfaces 8. The advantage of the curved recesses 13 and the spaces 19 they form is explained in greater detail in the description following for FIG. 4. The unloader fingers 2 are hooked into the force transmitting ring 6 such that the inferior surfaces of the grooves 5 are adjacent to the contact surfaces 8 and the unloader fingers 2 are positioned radially and axially.

Figure 4:
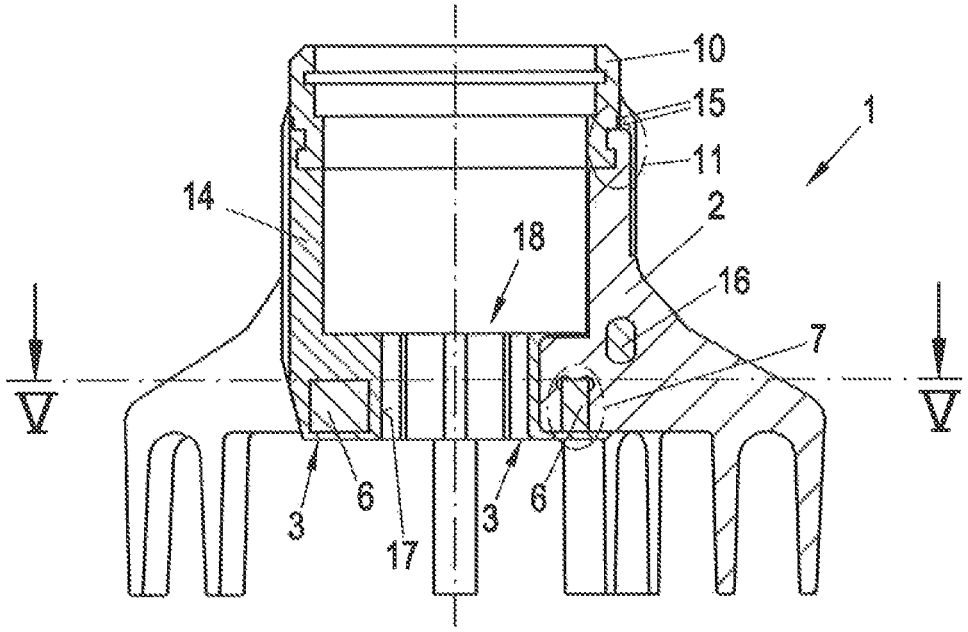
FIG. 4 is a sectional view of one advantageous embodiment of the finished unloader.

FIG. 4 is a sectional depiction of a finished unloader 1 in an advantageous embodiment. As has already been described for FIG. 1, the carrier bushing 14 is molded using a casting method, for instance die-casting or injection molding, in which the unloader 1 in accordance with FIG. 2, previously described and in a pre-assembled state, is inserted into a corresponding mold. At least part of the unloader fingers 2, the force transmitting ring 6, and the connection ring 10 are mould in with the material of the carrier bushing 14. Molding the individual components in ensures secure retention of the individual components, wherein the forces that act on the unloader fingers 2 during operation of the unloader 1 are absorbed primarily by the force transmitting ring 6 and the connection ring 10. In order to provide the best possible embedding of the unloader fingers 2 in the carrier bushing 14, in those areas of the unloader fingers 2 that are cast in, at least one cut-out 16 is provided, and material for the carrier bushing 14 flows therethrough and fills this cut-out 16 during the course of the casting of the carrier bushing 14. As may be seen from FIG. 1, however, a cut-out 16 is not absolutely necessary.

The curved recesses 13, already described for FIG. 3, on the interior edges, formed on the groove base, of the groove-like recesses 12 that are adjacent to the contact surfaces 8, permit the material for the carrier bushing 14 to flow freely in the central area 3 of the unloader fingers 2 and the force transmitting ring 6 at the first contact point 7 between force transmitting ring 6 and unloader finger 2 during casting and also to mould in at least part of the bottom side of the force transmitting ring 6 that faces the valve element 30. This effectively prevents any loosening of the force transmitting ring 6 during operation and again ensures secure retention of all components.

For the same reason, at least part of the second contact point 11 between connection ring 10 and unloader finger 2 is mould in with the material for the carrier bushing 14. In order to ensure better retention between carrier bushing 14 and connection ring 10, at least partially circumferential grooves or channels 15 may be provided on the exterior radial circumferential surface of the connection ring, at least some of which are mould in with the material for the carrier bushing 14.

Figure 6:
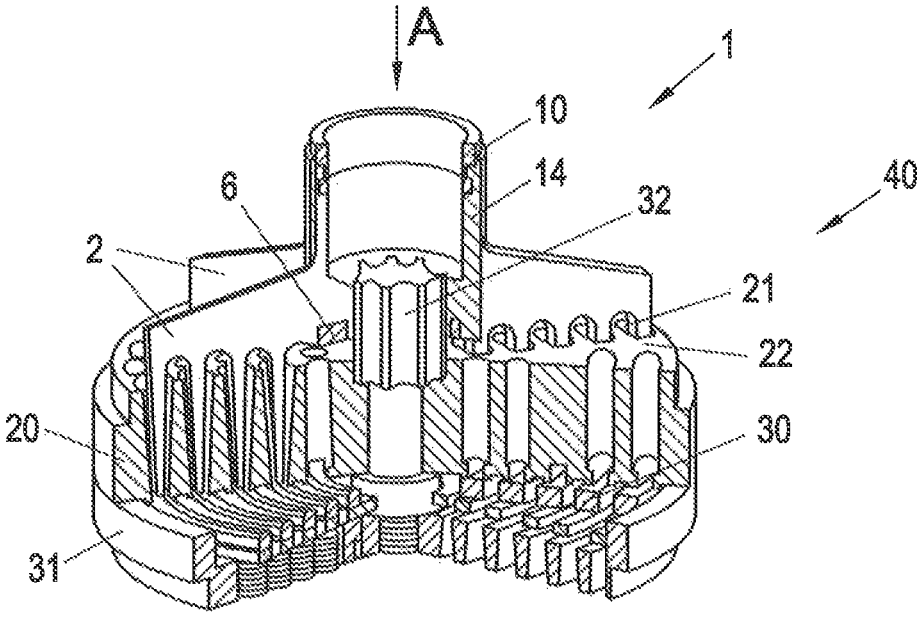
FIG. 6 is a perspective elevation of the unloader in combination with a compressor valve.

On its radially interior circumferential surface the carrier bushing 14 has a guide area 17 that, in combination with a guide pin 32 (as depicted in FIG. 6) guides the unloader 1. For instance, the carrier bushing 14 is fabricated from plastic or fiber-reinforced plastic, preferably from a tribologically favorable plastic, so that there are excellent slide conditions on the guide area 17, especially during dry running applications. If is therefore possible to do without the use of slide elements on the guide pin 32 of the unloader 1, so that the design is correspondingly simplified.

Figure 5:
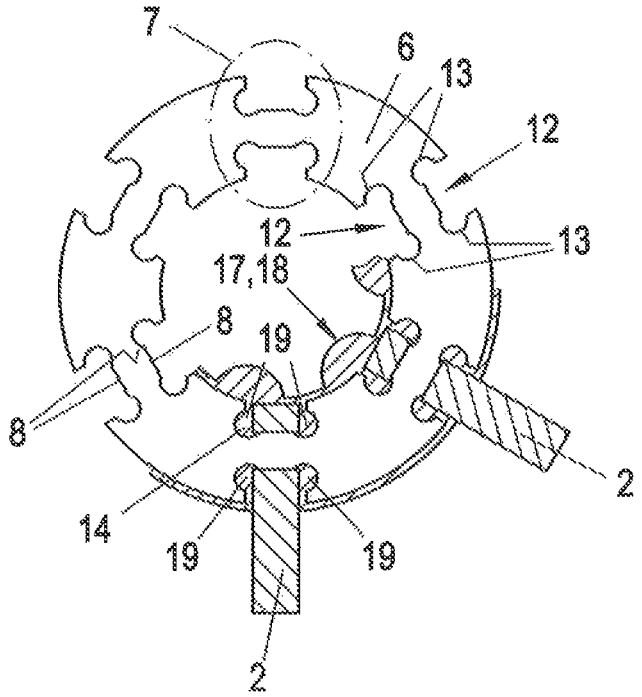
FIG. 5 is a section along the line V-V in FIG. 4.

FIG. 5 is a section along the line V-V in FIG. 4. In principle FIG. 5 depicts the structure illustrated in FIG. 3, but in the finally embodied situation. The free spaces 19 at the first contact point 7 between force transmitting ring 6 and unloader finger 2 are filled by the material of the carrier bushing 14. Thus no relative movement is possible between the central area 3 of the unloader fingers 2 and the force transmitting ring 6. The unloader fingers 2 are joined to the force transmitting ring 6 with no clearance and without the use of any fixing elements, such as for instance screws or the like. The same naturally also applies for the second contact point 11 between connection ring 10 and unloader fingers 2.

As already mentioned in the foregoing in the description of FIG. 2, in principle other options are possible for embodying the first contact point 7 between force transmitting ring 6 and unloader finger 2. For instance, with the proper embodiment of the first contact points 7 between force transmitting ring 6 and unloader finger 2, it would also be possible subsequently, that is, after the casting process has concluded, to screw the force transmitting ring 6 into the central area 3 of the unloader fingers 2 and into the carrier bushing 14.

FIG. 6 is a perspective elevation of the unloader 1 in combination with a compressor valve 40 such as is used for instance in reciprocating compressors. A compressor valve 40 normally comprises valve seat 20, valve element 31, and valve retainer 30. The unloader fingers 2 are guided through corresponding slits 21 that are in the valve seat 20 and that are interrupted by radial bars 22. In principle it is advantageous to prevent the unloader fingers 2 from coming into contact with the radial bars 22 of the valve seat 20 due to twisting. This would lead to undesired wear on the valve seat 20 and on the unloader fingers 2, possibly damaging the valve seat 20 and the unloader fingers 2 or resulting in malfunction due to increased friction. The carrier bushing 14 may therefore have a segment 18 with a non-circular cross-section that coincides for example with the guide area 17. The radial circumferential surface of the guide pin 32 is embodied inversely to the non-circular cross-section of the guide area 17 of the carrier bushing 14, wherein the guide pin 32 is embodied rotation-fast relative to the compressor valve 40. The cooperation of the circumferential surface of the guide pin 32 and the non-circular cross-section of the segment 18 of the carrier bushing 14 prevents the unloader 1 from twisting relative to the valve seat 20. The non-circular cross-section of the segment 18 may also be molded at another point on the radially interior circumferential surface of the carrier bushing and does not necessarily have to coincide with the guide area 17.

Figure 7:
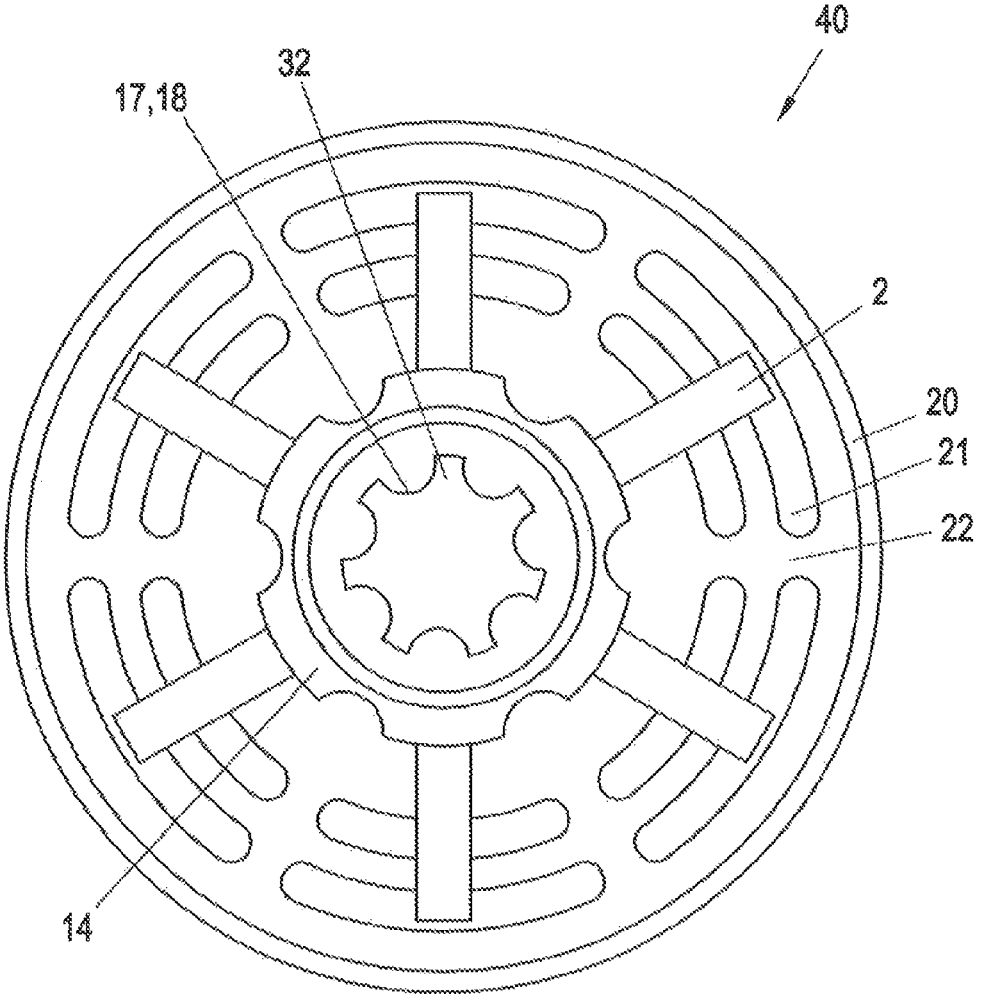
FIG. 7 depicts the a top view of the unloader, according to View A in FIG. 6, placed onto a compressor valve.

FIG. 7 depicts a top view of the unloader 1, according to View A in FIG. 6, placed onto a compressor valve 40. The unloader fingers 2 are guided by the slits 21 through the valve seat. The non-circular cross-section of the segment 18, which, as explained for FIG. 6, prevents undesired twisting of the unloader 1 relative to the valve seat 20 and thus prevents contact between the unloader fingers 2 and the radial bars 22, may be easily seen in the center of the carrier bushing 14.

Figure 8:
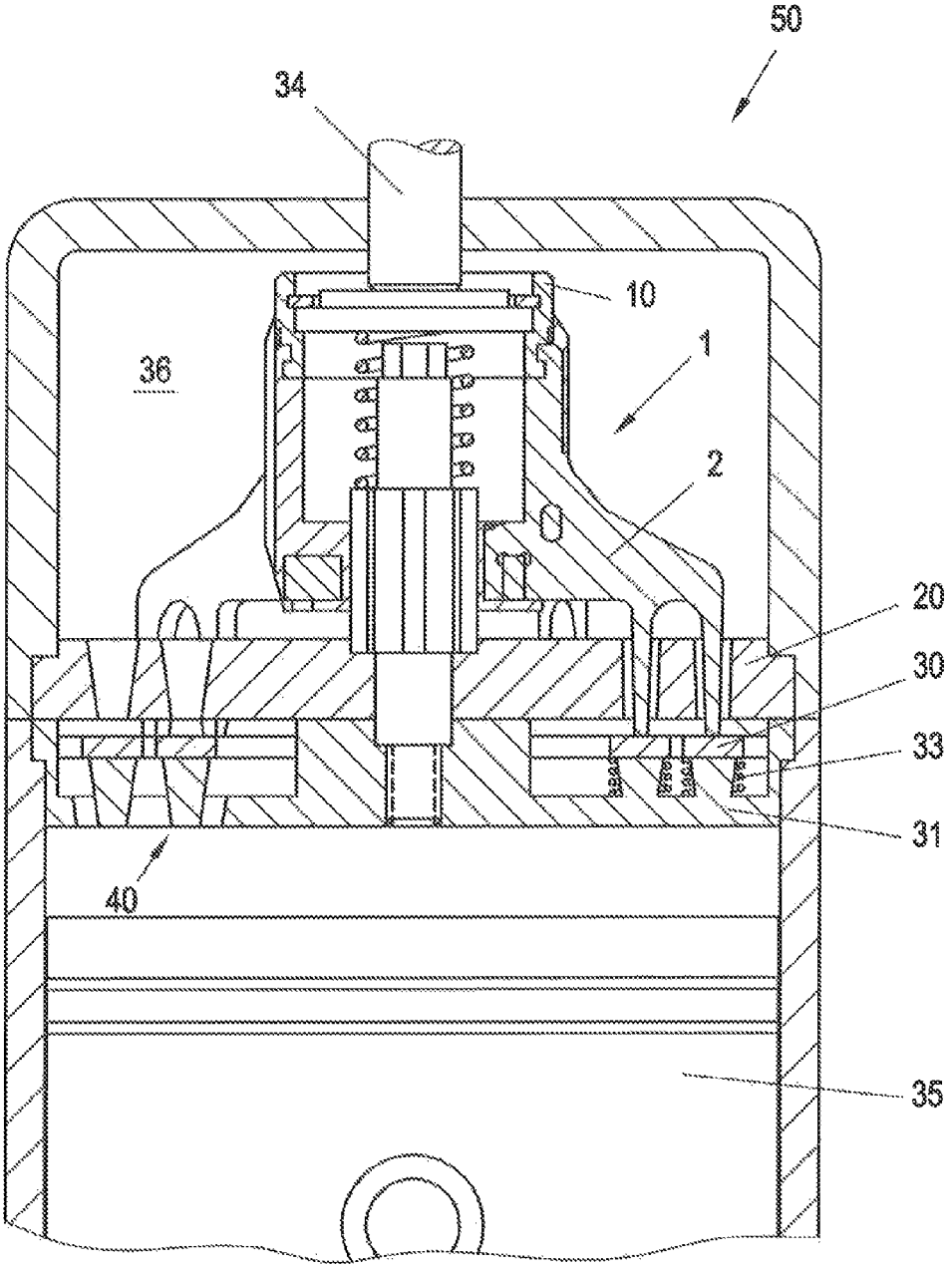
FIG. 8 depicts the unloader inside a reciprocating compressor.

FIG. 8 depicts the unloader 1 in the actuated position when it is used in a reciprocating compressor 50 that comprises at least one compressor valve (40) having at least one valve element (30) and that is depicted merely schematically. The unloader fingers 2 project through the valve seat 20 and press the valve element 30 against the spring force of the springs 33 and against the valve retainer 31. The actuating device 34, via which the unloader 1 is actuated, is depicted merely schematically.

Because of the depicted, actuated position of the unloader 1, the upward movement of the piston 35 pushes a compressor medium back for instance into the suction chamber 38. The result is that the capacity and thus also the input of the reciprocating compressor 50 is reduced, it being possible for instance to use this effect during the course of an idling adjustment or run up with minimal load.

The invention claimed is:

1. An unloader for a valve element of a compressor valve, the unloader comprising:

a carrier bushing, a centrally-located force-transmitting ring, and at least one unloader finger, each unloader finger being directly attached to the force-transmitting ring and in part embedded in material of the carrier bushing.

2. The unloader according to claim 1, including a plurality of unloader fingers circumferentially positioned relative to the carrier bushing.

3. The unloader according to claim 1, wherein said force-transmitting ring is at least partially embedded in the material of the carrier bushing.

4. The unloader according to claim 1, wherein a first contact point of each of the unloader fingers with the force transmitting ring is embedded in the material of the carrier bushing.

5. The unloader according to claim 1, wherein said force-transmitting ring includes a plurality of circumferentially-spaced recesses, and wherein each of said plurality of unloader fingers extends into a separate recess.

6. The unloader according to claim 1, wherein each of said plurality of unloader fingers includes a groove which contacts contact surfaces of the force-transmitting ring.

7. The unloader according to claim 2, including a connection ring, wherein each of said unloader fingers is attached to said connection ring.

8. The unloader according to claim 7, wherein each of said unloader fingers has a recess at one axial thereof, and wherein said connection ring has a circumferential projection that extends into the recesses.

9. The unloader according to claim 7, wherein the connection ring is at least partially embedded in the material of the carrier bushing.

10. The unloader according to claim 9, wherein a second contact point of the unloader fingers with the connection ring is at least partially embedded in the material of the carrier bushing.

11. The unloader according to claim 2, wherein said carrier bushing defines a hollow interior.

12. The unloader according to claim 11, wherein a segment of said hollow interior has a non-circular cross-section for cooperation with a guide pin of a compressor valve.

13. The unloader according to claim 2, wherein said material of the carrier bushing comprises plastic.

14. The unloader according to claim 1, wherein said material of the carrier bushing comprises plastic.

15. A method for fabricating an unloader for a valve element of a compressor valve, the unloader including at least one unloader finger and a carrier bushing, the method comprising the steps of:

(a) fabricating at least one unloader finger, (b) positioning said unloader finger from step (a) in a mould, and (c) forming the carrier bushing in said mould so that at least a portion of said unloader finger is mould in said formed carrier bushing.

16. The method according to claim 15, wherein said unloader finger and said carrier bushing are contact one another.

* * * * *